US005287572A

United States Patent [19]

Strobel

[11] Patent Number: 5,287,572

[45] Date of Patent: Feb. 22, 1994

[54] LEVER SUPPORTING SYSTEM FOR FOAM MATTRESS

[76] Inventor: Mark J. Strobel, 3131 Industrial Pkwy., Jeffersonville, Ind. 47130

[21] Appl. No.: 26,862

[22] Filed: Mar. 5, 1993

[51] Int. Cl.[5] ..... A47C 27/16; A47C 27/20

[52] U.S. Cl. ..... 5/464; 5/481; 5/476

[58] Field of Search ..... 5/481, 448, 464, 476; 297/DIG. 1

[56] References Cited

U.S. PATENT DOCUMENTS 641,854 1/1900 Gill ..... 5/448

4,639,952 2/1987 Kensinger ..... 5/481

FOREIGN PATENT DOCUMENTS 1593433 7/1981 United Kingdom ..... 5/481

OTHER PUBLICATIONS

"Foam-O-Lator", an ad on p. 47 of the May 1984 issue of Bedding Magazine May 13.

*Primary Examiner*—Alexander Grosz

*Attorney, Agent, or Firm*—James B. Middleton

[57] ABSTRACT

A mattress has a layer of generally straight levers embedded therein in at least one layer. As a heavy portion of the body pushes down on one end of levers, the opposite end pushes up to support an adjacent portion of the body. The levers may be spring material to render the reaction less severe. The ends of the levers are preferably connected together in groups by flexible strands. The strands maintain the organization within a layer, but allow movement in a direction perpendicular to the plane of the sleeping surface of the mattress. More than one layer of levers can be used when desired.

9 Claims, 1 Drawing Sheet

LEVER SUPPORTING SYSTEM FOR FOAM MATTRESS

BACKGROUND OF THE INVENTION

1. Field of the Invention

This invention relates generally to mattresses, and is more particularly concerned with a mattress having lever members for body support disposed between pad members.

2. Discussion of the Prior Art

Mattresses having springs within the mattress are well known in the art. Such mattresses typically include coil springs that extend generally in the direction of compression of the mattress to counteract the compressive forces. Insofar as the springs in fact counteract the compressive forces, the springs assist in supporting the body of a person lying on the mattress. The problem with such a mattress is that all the springs push up with generally equal force, so various parts of the body that may need more or less support all receive the same support.

Mattresses made of a foamed polymeric material, such as foamed polyurethane (PUR), are also well known in the art. Such mattresses most often comprise simply slabs of PUR foam. The advantage of such a mattress is that the foam tends to be compressed more in areas where the weight is greater, and compressed less where the weight is less. The result is that foam is available to support less massive portions of the body. However, when a heavy portion of the body pushes the foam down, the foam may be sufficiently deflected that support is not available for closely adjacent portions of the body.

SUMMARY OF THE INVENTION

The present invention provides a mattress having a plurality of levers therein for providing body support in response to body weight. The levers are within the mattress, or between two or more layers of padding, and force down on one end of the lever causes an upward force on the opposite end of the lever. As a result, heavy portions of the body provide down forces on the levers, so the opposite ends of the levers provide up forces on adjacent portions of the body.

In the preferred embodiment of the invention, a plurality of levers have their ends connected together by flexible members to hold the levers in place with respect to other levers, while allowing free motion in a direction perpendicular to the sleeping surface of the mattress.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
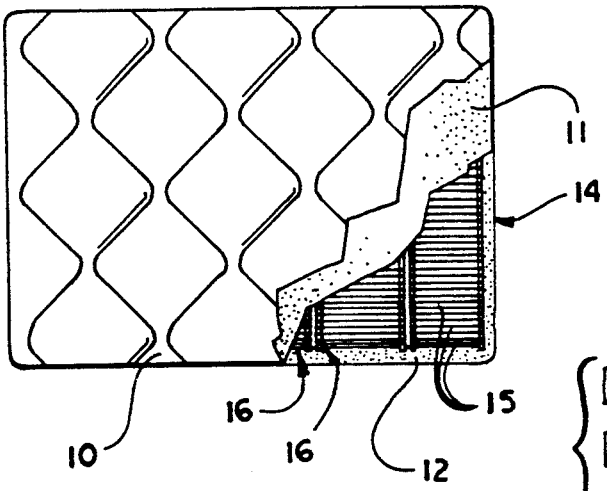
FIG. 1 is a top plan view, partially broken away, showing a mattress made in accordance with the present invention.

Referring now more particularly to the drawings and to those embodiments of the invention here presented by way of illustration, FIG. 1 shows a mattress having the usual quilted upper surface 10. The mattress shown in FIG. 1 is formed in two layers designated at 11 and 12, and the levers are between the two layers and are generally designated at 14. It will be seen that the levers 14 comprises a plurality of individual levers 15 that extend in the direction from head to foot of the mattress. A plurality of the levers is grouped, one group extending transversely of the mattress. Successive groups, then, cover substantially the entire area of the mattress.

The padding 11 and 12 is here indicated as a foamed material, for example polyurethane (PUR); but, it should be understood that other padding materials are also contemplated. Cotton or other fibers may be used, and two relatively thin fiber mattresses can be put together with levers to practice the present invention.

Figure 2:
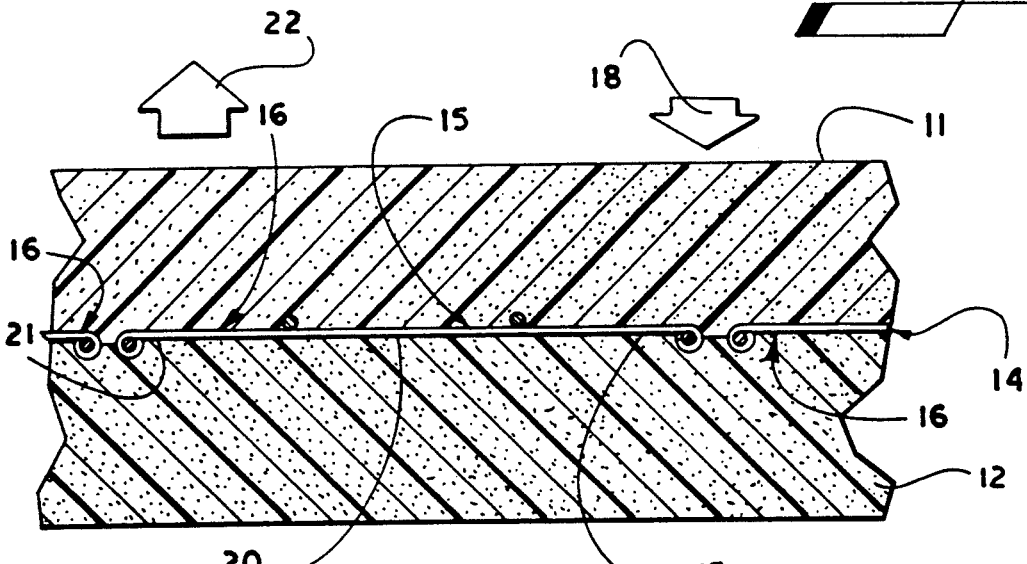
FIG. 2 is an enlarged, cross-sectional view taken through a mattress of the type shown in FIG. 1.
Figure 3:
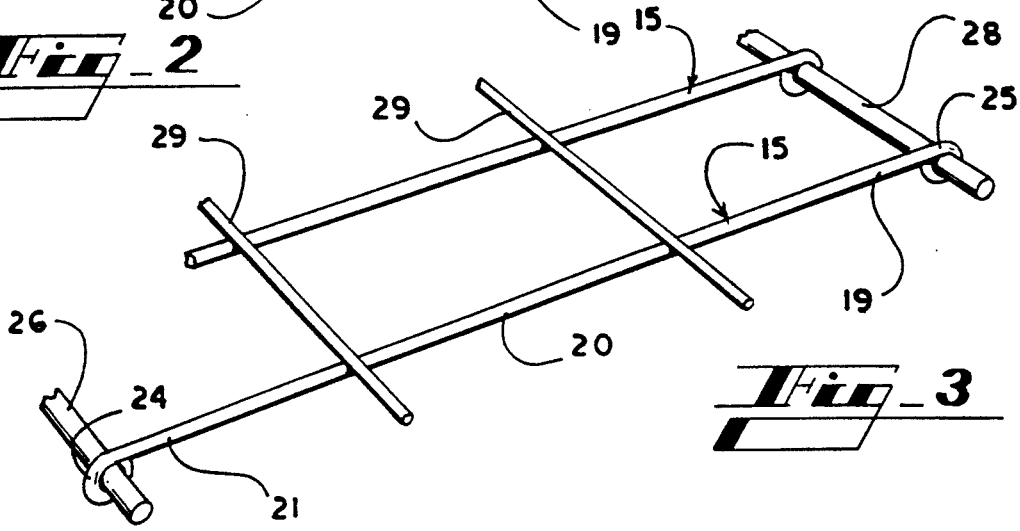
FIG. 3 is an enlarged perspective view showing the lever arrangement used in the mattresses of FIGS. 1 and 2; and, FIG. 4 is an exploded side elevational view showing a modified form of the mattress illustrated in FIG. 1.

Attention is directed to FIGS. 2 and 3 of the drawings for a full understanding of the construction of the lever system of the present invention. FIG. 2 is a cross-sectional view showing the relationship of the levers and the padding, and FIG. 3 is a perspective view showing the arrangement of the levers and the grouping means.

It will be seen from FIG. 2 that each group 16 is separate from the other groups 16, so each group 16 can act independenty. With this in mind it can be understood that, if there is a force down in the upper layer 11 as indicated by the arrow 18, the force will cause both the upper and lower layers 11 and 12 to be deflected downward. This deflection will of course carry the end 19 of the lever 15 with it.

As the end 19 of the lever 15 moves down, the padding in the center area 20 of the lever 15 will not be deflected, so the lever 15 will act as a first class lever: a force 18 is exerted at the end 19; the foam at the center 20 acts as a fulcrum; and, the foam of the upper layer 11 acts as the load, or resistance, at the end 21. Thus, there will be an upward force as indicated by the arrow 22 as a result of the downward force indicated by the arrow 18.

It will be readily recognized that not all levers 15 in a particular group 16 will receive the same force. As a result, the individual levers 15 need to be able to react independently. In order to maintain the orderly orientation and grouping while allowing individual freedom, the levers 15 are connected together by flexible means. Each of the levers 15 is here shown as having loops 24 and 25 at its opposite ends. The loops 24 and 25 receive transverse strands therethrough, the strands 26 and 28 being formed of a flexible material.

Many different materials can be used for the strands 26 and 28, including paper, plastic, rubber, fabrics and the like. The strands 26 and 28 are important for retaining the levers 15 within the groups 16, and retaining the organization of the levers 15 within the groups. It will be readily recognized that, if the levers 15 are not constrained, the levers will quickly become randomly scattered so the effect would be unpredictable. Thus, the strands 26 and 28 pass through the loops 24 and 25 and maintain the organization while allowing each lever 15 to move vertically in response to forces applied to the mattress.

It will be noticed that the groups 16 shown in the drawings also include additional strands 29. These may be included when further control of the individual levers 15 is required, but may not be needed in all cases. The strands 29 will also be made of flexible material that allows individual motion of the levers while holding the levers within the organized pattern.

In the foregoing discussion, the levers 15 have been treated as rigid members. While use of rigid members as levers 15 is possible, it is contemplated that somewhat bendable levers 15 will be preferable. By using spring members as the levers 15, the levers 15 will conform to the mattress to some extent and be less severe in their application of force. The particular spring material can be selected to achieve the specific result desired, but a spring wire of around 10 to 18 gauge, AWG, is the preferred range.

Though the above description includes two padding members and one layer of levers, it should be understood that multiple layers of levers are also contemplated in the present invention. With attention to FIG. 4 of the drawings, there is an upper layer of padding 11*a*, a lower layer 12*a*, and a middle layer 13. Between the upper layer 11*a* and the middle layer 13, there is one layer 14*a* of levers; and, between the middle layer 13 and the lower layer 12*a*, there is another layer 14*b* of levers.

Figure 4:
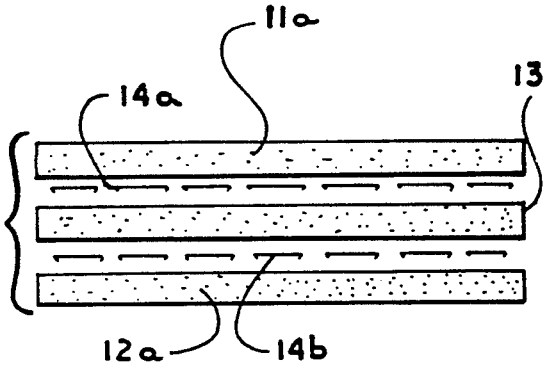

FIG. 4 is somewhat schematically presented, but it can be seen that the layers of levers 14*a* and 14*b* each comprise a plurality of groups 16 extending from the head of the mattress to the foot. As here shown, each group of levers in the layer 14*a* is directly above a group in the layer 14*b*. As a result, the effects of the two layers of levers will be additive.

By utilizing a plurality of layers of levers, it will be understood that one might have a mattress of conventional thickness, and have levers closer to the surfaces of the mattress for a more pronounced effect. While the levers can be placed close to the surface of a mattress, one would not have the same effect on both sides of the mattress without a plurality layers of levers. Further, if one wish to have an exceptionally thick mattress, it may be necessary to have plurality layers of levers to achieve the desired effect on both sides of the mattress.

It will be equally well understood that two separate layers of levers can be placed in one mattress, and the two layers of levers may be separated sufficiently by the middle layer 13 that one layer 14*a* does not affect the other layer 14*b*.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

We claim:

1. A mattress having a sleeping surface, a head end and a foot end, said mattress comprising an upper pad juxtaposed on a lower pad, and a layer of levers between said upper pad and said lower pad, said layer of levers comprising a plurality of groups of levers, each group of said plurality of groups of levers including a plurality of independent levers having first ends and second ends, each lever in said layer of levers extending in a direction perpendicular to said head end and said foot end and lying in a plane parallel to said sleeping surface, each lever of said plurality of independent levers being independently movable so that a downward force on said sleeping surface will cause a downward movement of said first end of at least one lever of said plurality of levers and consequent upward motion of the second end of said at least one of said plurality of levers.

2. A mattress as claimed in claim 1, and further including a first means for holding said first ends generally in position within said plane parallel to said sleeping surface, and second means for holding said second ends generally in position within said plane parallel to said sleeping surface.

3. A mattress as claimed in claim 2, said first means and said second means comprising flexible strands fixed to said levers.

4. A mattress as claimed in claim 2, said layer of levers including a sufficient number of said groups of levers that said layer of levers is substantially coextensive with said sleeping surface.

5. A mattress as claimed in claim 4, wherein said upper pad and said lower pad consist of a foamed polymeric material.

6. A mattress as claimed in claim 4, wherein said upper pad and said lower pad consist of foamed polyurethane.

7. A mattress as claimed in claim 1, each lever in said layer of levers consisting of a spring material.

8. A mattress as claimed in claim 7, and further including a middle pad of said mattress, said layer of levers being between said upper pad and said middle pad.

9. A mattes as claimed in claim 8, and including a second layer of levers between said middle pad and said lower pad.

* * * * *